United States Patent [19]

Pridham

[11] 4,033,537

[45] July 5, 1977

[54] KNITTING MACHINE STAND

[76] Inventor: Brian Frederick Pridham, 20 Firebrace St., Horsham, Victoria, Australia, 3400

[22] Filed: July 16, 1974

[21] Appl. No.: 489,039

[30] Foreign Application Priority Data

July 18, 1973 Australia ..... 4128/73
Aug. 3, 1973 Australia ..... 4345/73

[52] U.S. Cl. ..... 248/165; 108/6; 248/166

[51] Int. Cl.² ..... F16M 11/32

[58] Field of Search ..... 248/165, 166, 163, 371, 248/127, 346; 108/3, 6, 59, 111, 134; 38/103, 104, 106, 112, 135–139; 16/128, 166, 191; 112/217.1

[56] References Cited

UNITED STATES PATENTS

| | | | |
|---|---|---|---|
| 466,303 | 12/1891 | Hetterschied | 108/6 |
| 774,599 | 11/1904 | McMullen | 38/136 X |
| 2,284,951 | 6/1942 | Doman | 16/166 X |
| 2,989,142 | 6/1961 | Gill | 248/165 X |
| 3,376,069 | 4/1968 | Lowdermilk | 248/165 X |
| 3,389,854 | 6/1968 | Coopersmith | 16/191 X |

FOREIGN PATENTS OR APPLICATIONS

| | | | |
|---|---|---|---|
| 55,714 | 5/1911 | Switzerland | 108/3 |

*Primary Examiner*—Roy D. Frazier
*Assistant Examiner*—Terrell P. Lewis
*Attorney, Agent, or Firm*—Cushman, Darby & Cushman

[57] ABSTRACT

A stand for a knitting machine having an upper substantially horizontal main support frame with downwardly extending legs for supporting the stand at a predetermined height above ground level and releasably attached to the main support frame, or pivotally attached thereto to enable them to be folded thereagainst. The knitting machine is clamped to a support section which is pivotally supported on the main support frame for rotation about a substantially horizontal axis for tilting the machine from one operating position to another. The support section consists of two parts extending from either end of the main support frame and interconnected by a common pivot axle with means to clamp the axle in any desired position.

5 Claims, 7 Drawing Figures

KNITTING MACHINE STAND

This invention relates to a stand for a knitting machine, and more particularly to a stand having means whereby the support for the knitting machine may be rotated to thereby tilt a machine supported thereon between various working positions for the machine.

During the use of a conventional knitting machine it is necessary to tilt the machine between at least two working positions depending on the particular knitting operation to be carried out.

It is common practise to provide a stand for a knitting machine, and with known stands brackets or clamps are provided for supporting the machine on the stand. However, when the machine to be tilted to a new working position it has been the practise to remove the support clamps supporting the machine and substituting new clamps which will automatically hold the machine at the new desired tilted position.

The present practise is requiring at least two different sets of clamps for the two common tilted positions required for different knitting operations therefore adds to the overall cost of the stand for the machine, and also due to the requirement for changing the clamps and substituting different clamps is therefore also time consuming.

It may therefore be an object of the present invention to provide a stand for knitting machine including provisions for tilting the machine supported thereon between predetermined positions without disconnecting the machine from the stand and substituting a separate set of clamps.

The object of the invention may be achieved by clamping the machine to a special support the stand which support is adapted to rotate and thus allow the machine to be tilted to any particular orientation.

The invention may therefore envision a stand for a knitting machine having a main support frame and two support sections pivotally supported on the support frame to extend away from either end of the main support frame for rotation between one operating position and a third operating position and adapted in use for supporting a knitting machine attached at either end thereof to the respective support sections. The support sections are mounted on a common support axle which extends through the main support frame. Clamping means which are supported on the main frame engage the common support axle to releasably hold the support axle fixed with respect to the main frame at either operating position. Stop means are provided on the main support frame and cooperate with the common support axle for restricting the movement of the support axle to movements between the operating positions.

Figure 1:
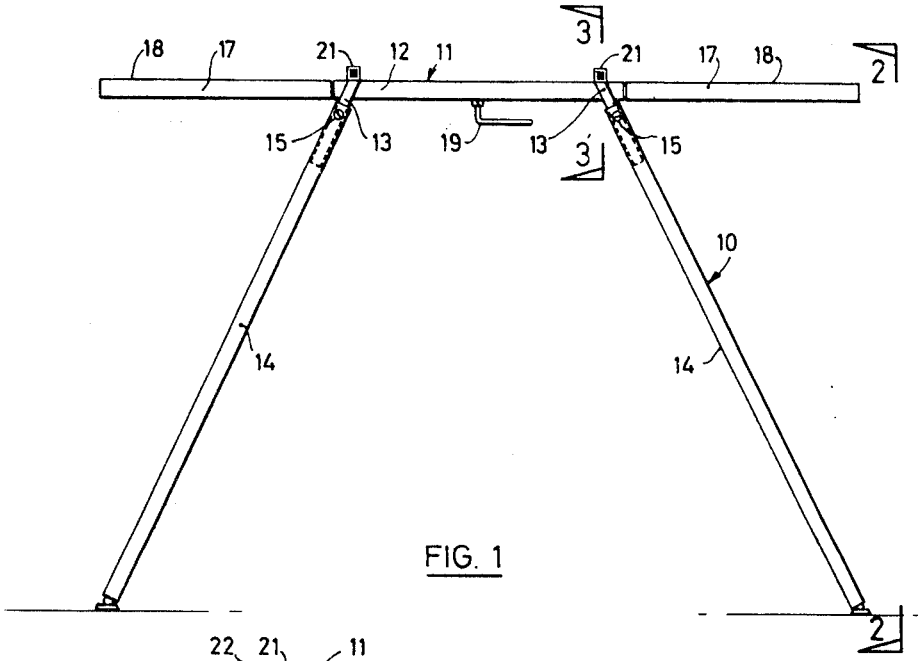
Figure 2:
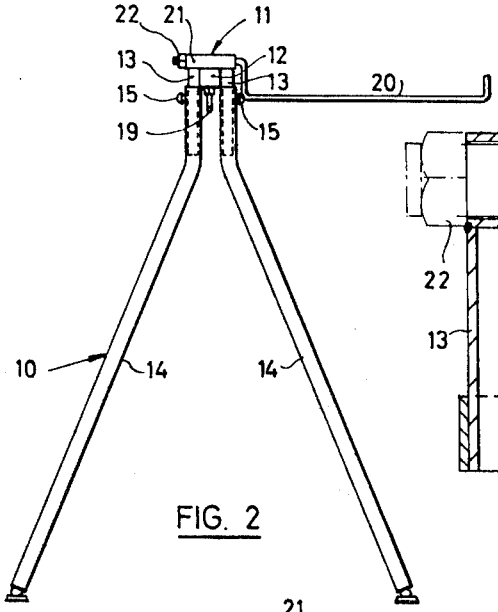
Figure 3:
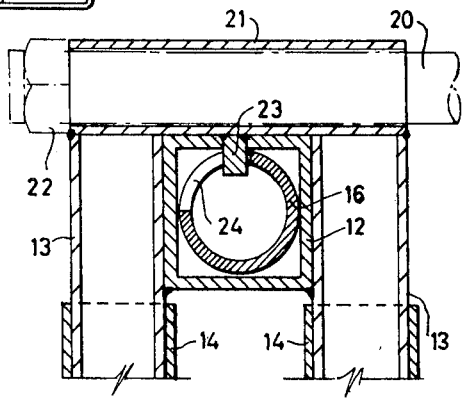
Figure 4:
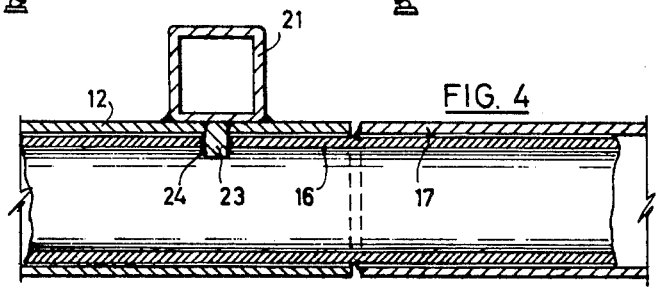
Figure 5:
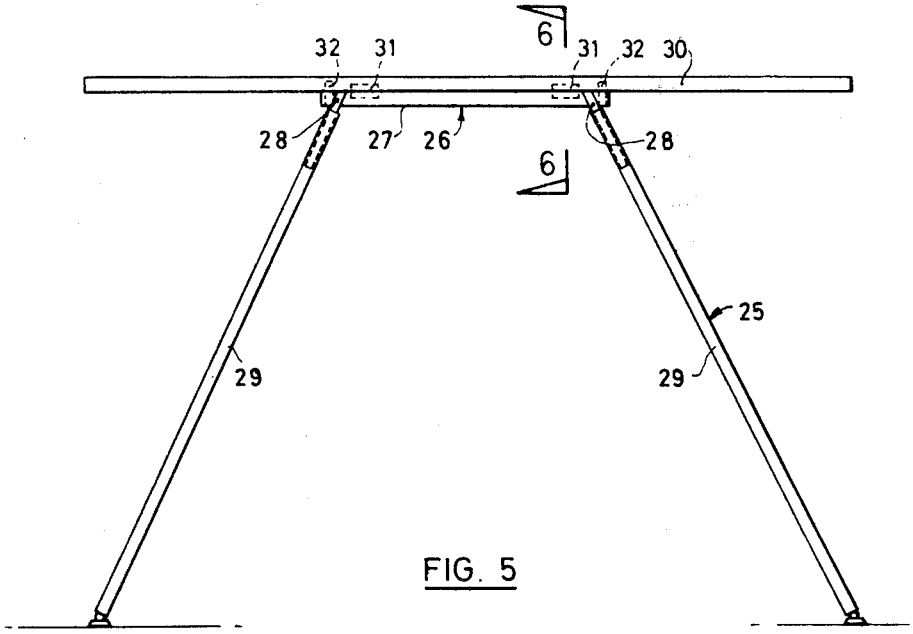
Figure 6:
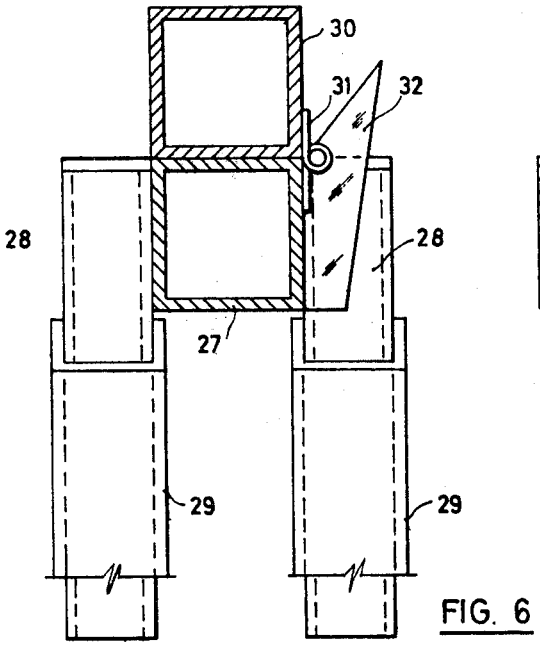
Figure 7:
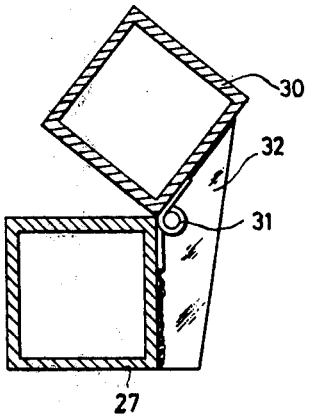

One preferred form of the invention will now be described with reference to the accompanying drawings in which;

FIG. 1, is a side elevational view of the preferred form of stand according to the invention, FIG. 2 is an end elevational view of the stand of FIG. 1 viewed in the direction of arrows 2—2, FIG. 3 is an enlarged view of section of the stand of FIG. 1 viewed in the direction of arrows 3—3, and FIG. 4 is an enlarged side view of section of the stand.

The stand according to the preferred form of the invention as illustrated in FIGS. 1 to 4, includes a main support frame 10 including an upper section 11 in the form of a longitudinally extending tubular member 12 to which are attached, for example by welding, a plurality (usually four) downwardly extending short pillars 13 over the ends of which are slipped the upper ends of a matching number of tubular legs 14, which legs are of such a length to support the upper section of the stand at a convenient height above floor level. The upper ends of the legs are held in position on the respective pillars by means of screw connections 15.

A support axle 16 entends axially through the tubular member 12 constituting the upper section 11 of the frame 10 to extend outwardly away from either end thereof, and at each end a support member 17 in the form of a tubular support member are received over the ends of the support axle 16 and fixedly attached thereto, thus providing at each end of the upper section 11 of the frame a pair of knitting machine support sections 18 to which the machine can be attached by clamps or the like.

With such an arrangement rotation of the support axle 16 within the upper tubular member 12 of the frame causes the support sections 18 attached to ends of the support axle 16 to rotate and thus tilt the machine attached thereto to any desired operating position.

In order to hold the support axle 16, and thus the support members 17 attached at either end thereof, and thus the knitting machine supported on the support sections, at a particular position a simple screw clamp 19 is utilized and extends through a cooperatingly threaded opening extending transversely through the wall of the upper tabular member and has a bent handle portion by which it may be gripped and turned such that the inner end of the screw portion bears against the support axle 16 and presses it against the opposite side of the upper tubular member 12 to clamp the axle 16 at any desired fixed position.

The support axle 16 is manufactured from a length of tubular rod adapted to rotate within an upper tubular member 12 of closely fitting square cross section. The support members 17 are also of square cross section, and at either end thereof are welded or otherwise attached to the support axle 16.

In practise a pair of support arms 20 are attached to the upper section of the stand to extend away from the side thereof opposite to the position of an operator of a knitting machine mounted on the stand. The support arms 20 support a working table for holding an upwardly extending holder for a spool of yarn, thread or wool, and any other implements used by the operator during the working of the machine.

According to this preferred form of the invention one end of each support arm is threaded and is received through tubular members 21 attached to the upper section 11 of the frame, and nuts 22 hold the arms in position.

Alternatively the legs 14 may be retained on the pillars 13 by the inner ends of the support arms 20 adapted to be received in aligned holes in both the legs 14 and the pillars 13 thereby dispensing with the separate screw connections 15 and also the tubular members 21 for the support arms, thereby accomplishing connection of the legs and mounting of the support arms by a shared facility.

As a further alternative the legs and the support arms for the working table may be pivotally attached to the upper section of the main frame instead of being completely dismounted for storage and transportation purposes, and by means of the pivotal connection may be folded against the remainder of the stand for such purposes.

In order to control the movement between the operating positions the tubular member 12 has an inwardly directed pin 23 which is receivable in a circumferentially extending slot 24 through the axle 16, the ends of which slot determined to extemes of the operating positions.

I claim:

1. A stand for a knitting machine having a main support frame and two support sections pivotally supported on said support frame to extend away from either end of the main support frame for rotation between one operating position and a tilted operating position and adapted, in use, for supporting a knitting machine attached at either end thereof to the respective support sections, said support sections being mounted on a common support axle extending through the main support frame, clamping means supported on said main frame to engage said common support axle to releasably hold said support axle fixed with respect to said main frame at either operating position, and stop means provided on said main support frame and cooperating with said common support axle for restricting the movement of said support axle to movements between said operating positions.

2. A stand as claimed in claim 1 wherein said main support frame includes downwardly extending legs adapted to support the stand at a predetermined height above ground or floor level.

3. A stand as claimed in claim 2 wherein an upper section of said main frame includes downwardly extending pillars adapted to slideably receive the upper ends of said legs, whereby the stand can be readily dismounted by detaching the legs from the pillars.

4. A stand as claimed in claim 2, wherein the legs are pivotally attached to an upper section of said main frame, whereby they may be rotated into folded position for storage or transportation purposes.

5. A stand as claimed in claim 1, wherein the main support frame carries a pair of support arms adapted to support working table.

* * * * *